US008104316B2

(12) United States Patent
Hirase et al.

(10) Patent No.: US 8,104,316 B2
(45) Date of Patent: Jan. 31, 2012

(54) PIERCING MILL

(75) Inventors: Naoya Hirase, Osaka (JP); Tomio Yamakawa, Osaka (JP); Kazuhiro Shimoda, Osaka (JP)

(73) Assignee: Sumitomo Metal Industries, Ltd., Osaka (JP)

( * ) Notice: Subject to any disclaimer, the term of this patent is extended or adjusted under 35 U.S.C. 154(b) by 0 days.

(21) Appl. No.: 12/568,698

(22) Filed: Sep. 29, 2009

(65) Prior Publication Data

US 2010/0011831 A1 Jan. 21, 2010

Related U.S. Application Data

(63) Continuation of application No. PCT/JP2008/050277, filed on Jan. 11, 2008.

(30) Foreign Application Priority Data

Mar. 30, 2007 (JP) ..... 2007-090644

(51) Int. Cl.
*B21B 19/04* (2006.01)

(52) U.S. Cl. ..... 72/97; 72/227; 72/251

(58) Field of Classification Search ..... 72/95, 96, 72/97, 98, 208, 209, 226, 227, 251, 250, 72/365.2, 366.2
See application file for complete search history.

(56) References Cited

U.S. PATENT DOCUMENTS

| | | | | | |
|---|---|---|---|---|---|
| 401,143 | A | * | 4/1889 | Flagler | 72/97 |
| 636,335 | A | * | 11/1899 | Hampton | 72/97 |
| 1,219,802 | A | * | 3/1917 | Brightman | 72/97 |
| 1,999,987 | A | * | 4/1935 | Diescher | 72/97 |
| 2,306,827 | A | * | 12/1942 | Mohan | 72/97 |
| 2,309,690 | A | * | 1/1943 | Aiken | 72/97 |
| 3,550,415 | A | * | 12/1970 | Tarenskeen | 72/31.07 |
| 4,006,618 | A | * | 2/1977 | Yanagimoto et al. | 72/11.3 |
| 4,318,294 | A | * | 3/1982 | Yoshiwara et al. | 72/97 |
| 4,719,785 | A | * | 1/1988 | Gancia | 72/250 |
| 4,798,071 | A | * | 1/1989 | Staat et al. | 72/97 |
| 4,803,861 | A | * | 2/1989 | Kuemmerling et al. | 72/97 |
| 4,928,507 | A | * | 5/1990 | Staat et al. | 72/38 |

FOREIGN PATENT DOCUMENTS

| | | | |
|---|---|---|---|
| JP | 63-174704 | | 7/1988 |
| JP | 63-220907 | * | 9/1988 |
| JP | 64-15601 | | 1/1989 |
| JP | 7-9013 | | 1/1995 |
| JP | 9-10806 | | 1/1997 |
| JP | 2000-246311 | | 9/2000 |
| JP | 2001-162306 | | 6/2001 |
| JP | 2006-297400 | | 11/2006 |

* cited by examiner

*Primary Examiner* — Edward Tolan
(74) *Attorney, Agent, or Firm* — Clark & Brody

(57) ABSTRACT

A piercing mill includes a plurality of inclined rolls, a plug, a pusher, and an undriven guide roll. The pusher pushes a round billet from the rear end at least until the round billet advances for a prescribed distance after contacting the inclined rolls. The guide roll is between the inclined rolls and the pusher and includes a roll shaft and a roll surface, with the roll shaft arranged obliquely with respect to a pass line PL. The sectional shape of the roll surface is a concave arch shape. The round billet is rotated by the guide roll and the friction force generated when the round billet contacts the inclined rolls is reduced. Consequently, the wear of the inclined rolls can be restrained if the round billet is pierced and rolled while it is pushed in between the inclined rolls using the pusher.

3 Claims, 7 Drawing Sheets

PIERCING MILL

This application is a continuation of International Patent Application No. PCT/JP2008/050277, filed Jan. 11, 2008. This PCT application was not in English as published under PCT Article 21(2).

TECHNICAL FIELD

The present invention relates to piercing mills and more specifically to a piercing mill that pierces and rolls a round billet into a hollow shell.

BACKGROUND ART

A piercing mill pierces and rolls a round billet into a hollow shell. The piercing mill includes two or three inclined rolls provided at equal intervals around a pass line, a pusher provided along the pass line in front of the inclined rolls, and a plug provided on the pass line between the plurality of inclined rolls.

When a round billet is pierced and rolled by the above-described piercing mill, the resulting hollow shell has defects at its inner surface because of the Mannesmann effect. In general, as the billet diameter reduction at plug nose represented by Expression (1) is smaller, such inner surface defects are more restrained.

$$\text{Billet diameter reduction at plug nose}(\%)=(\text{round billet diameter}-\text{roll interval at plug tip end})/\text{round billet diameter}\times 100 \quad (1)$$

However, if the billet diameter reduction at plug nose is reduced, the round billet is less easily bitten between the plurality of inclined rolls, in other words, so-called defective biting is likely to result.

A technique for reducing such defective biting even if the billet diameter reduction at plug nose is small is disclosed by JP 2006-297400 A.

According to the disclosure, a plurality of skew rollers are provided in front of the inclined rolls and a pinch roller is provided between the plurality of skew rollers and the inclined rolls. The plurality of skew rollers are coupled with a driving source such as a motor and rotated by the driving source to advance a round billet. Furthermore, the pinch roller coupled with the driving source rotates while it holds the round billet, so that the round billet is advanced while being rotated in the circumferential direction. Therefore, if the billet diameter reduction at plug nose is small, the defective biting can be prevented.

However, the force of the pinch roller is not strong enough to push the round billet in contact with the inclined rolls in the axial direction. Therefore, if the billet diameter reduction at plug nose is small, it is highly possible that defective biting is caused. The pinch roller rotates at a fixed circumferential speed by the driving source, while the round billet has its advancing speed greatly changed during the period after it contacts the inclined rolls until it is stably bitten therebetween, and sometimes its advancing speed can be lower than the circumferential speed of the pinch roller. In this way, if the advancing speed of the round billet is different from the circumferential speed of the pinch roller, the pinch roller slips on the surface of the round billet, which results in outer surface defects.

Another technique for restraining defective biting even if the billet diameter reduction at plug nose is small is disclosed by JP 2000-246311 A and JP 2001-162306 A. According to the disclosure of these documents, a round billet is pushed to advance by a pusher and the pusher pushes the round billet in between the inclined rolls. In this case, if the round billet is not bitten between the plurality of the inclined rolls and slips, the pusher pushes the rear end of the round billet to advance and therefore the round billet is eventually pushed in between the inclined rolls. Therefore, defective biting can be prevented.

However, if the billet diameter reduction at plug nose is reduced and the round billet pierced and rolled while it is pushed in between the inclined rolls using the pusher, the inclined rolls are increasingly worn. This is because defective biting is prevented by the pushing force of the pusher and external force applied upon the inclined rolls by the pusher is greater than the case in which the billet diameter reduction at plug nose is high. Therefore, the frictional force of the round billet in the rotating direction increases, and the wear amount at a part of the surface of the inclined rolls initially contacted to the round billet particularly increases. The wearing of the inclined rolls not only lowers the biting property but also gives rise to an outer surface defect.

DISCLOSURE OF THE INVENTION

It is an object of the invention to provide a piercing mill that allows the wear amount of a plurality of inclined rolls to be reduced when a round billet is pierced and rolled while it is pushed in between the inclined rolls using a pusher.

A piercing mill according to the present invention includes a plurality of inclined rolls, a pusher, and a first guide roll. The plurality of inclined rolls are provided around a pass line. The pusher is provided in front of the inclined rolls (on the inlet side) to push the round billet forward from the rear end at least until the round billet advances for a prescribed distance after contacting the inclined rolls. The first guide roll is provided between the inclined rolls and the pusher. The first guide roll includes a first roll shaft arranged obliquely with respect to the pass line and a first roll surface having a concave arch sectional shape in the direction of the first roll shaft. The first guide roll is undriven. Here, the pass line is a virtual axial line on which a round billet in the process of piercing and rolling is moved.

When the pusher pushes the round billet forward, the round billet is pressed against the plurality of inclined roll surfaces, which increases friction force at the contact part between the round billet and the roll surface. The piercing mill pierces and rolls the round billet by rotating the round billet in the same direction as the rotation direction of the plurality of inclined rolls. The above described friction force is large, the torque necessary for the plurality of inclined rolls to rotate the round billet in the circumferential direction increases. The increase in the torque increases the wear amount of the inclined rolls accordingly.

According to the present invention, the first guide roll having its shaft center inclined obliquely with respect to the pass line is provided between the pusher and the plurality of inclined rolls. The first guide roll rotates the round billet advanced in the rolling direction by the pusher along the pass line. Stated differently, the round billet that has passed the first guide roll advances while it is rotated helically. The plurality of inclined rolls contact the round billet rotated in advance, and therefore the torque necessary for rotating the round billet in the circumferential direction is small. Consequently, the wearing of the incline rolls can be restrained.

Furthermore, since the first guide roll is undriven (i.e., a free-roll), the first guide roll rotates following the movement of the round billet. Therefore, the first guide roll is less likely to slip on the round billet surface and outer surface defects on the round billet can be restrained.

The piercing mill preferably further includes a second guide roll. The second guide roll is provided opposed to the first guide roll with the pass line therebetween. The second guide roll includes a second roll shaft and a second roll surface. The second roll shaft crosses the first roll shaft. The second roll surface has a concave arch sectional shape in the direction of the second roll shaft. The second guide roll is undriven (i.e., a free roll).

In this case, the round billet is held between the first and second guide rolls and provided with rotation by the first and second guide rolls. Therefore, the round billet is less likely to be shifted in the horizontal direction from the pass line and moves straightforward stably on the pass line. The round billet restricted by the first and second guide rolls is effectively rotated.

The piercing mill preferably includes a plurality of the first guide rolls and a second guide roll. The second guide roll includes the second roll shaft described above and the second roll surface and is undriven (i.e., a free-roll). The plurality of first guide rolls and the second guide roll are arranged zigzag along the pass line.

In this way, the round billet contacts the three or more guide rolls (the plurality of first guide rolls and the second guide roll) arranged in the zigzag manner along the pass line. Therefore, the round billet is less likely to be shifted both in the horizontal and vertical directions.

BEST MODE FOR CARRYING OUT THE INVENTION

Figure 1:
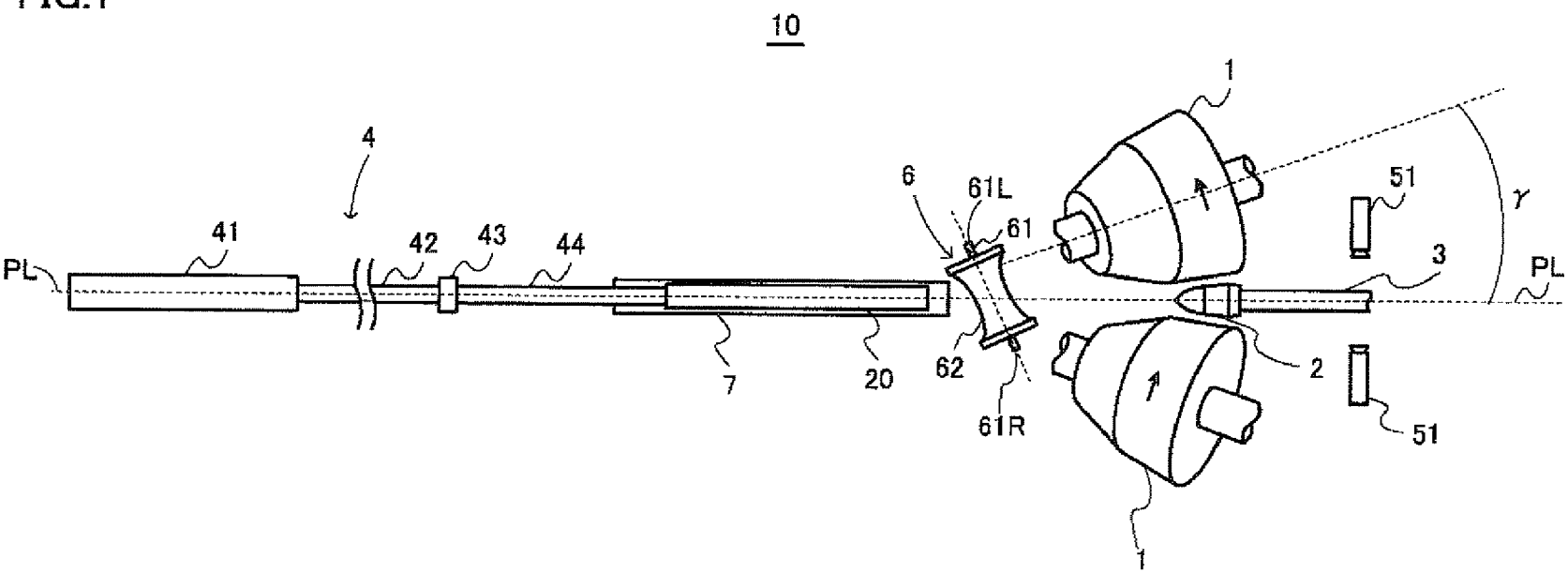
FIG. 1 is a schematic view of a piercing mill according to a first embodiment of the invention as viewed from above.

Now, embodiments of the invention will be described in detail in conjunction with the accompanying drawings, in which the same or corresponding portions are denoted by the same reference characters and their description is not repeated.

First Embodiment

General View

Figure 2:
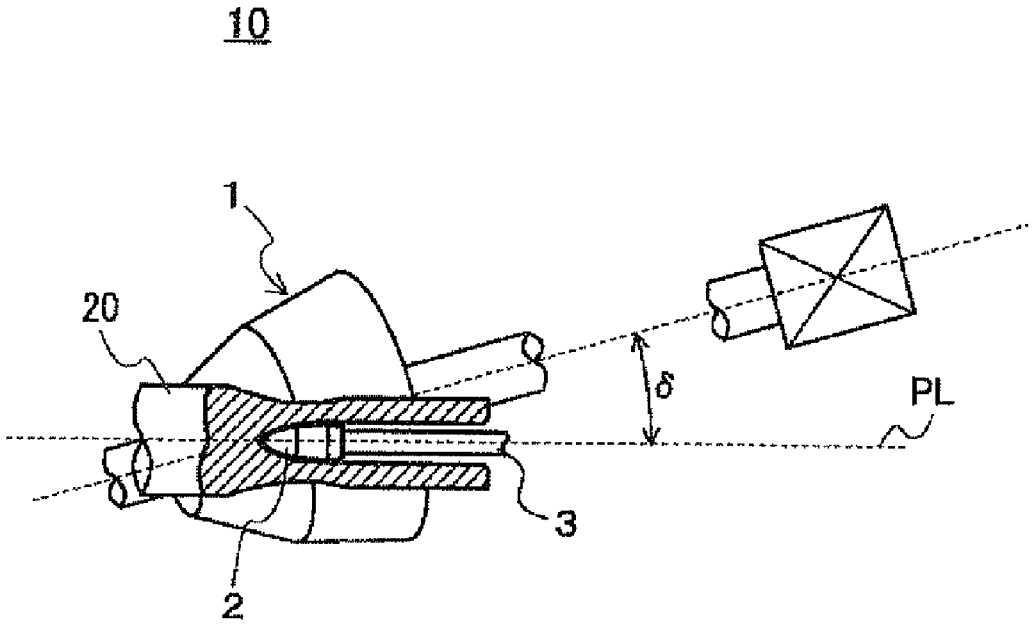
FIG. 2 is a side view of a piercing mill in the process of piercing and rolling.

With reference to FIGS. 1 and 2, a piercing mill 10 includes two cone type inclined rolls (hereinafter simply as "inclined rolls") 1, a plug 2, a mandrel 3, a pusher 4, an inlet trough 7, an HMD (Hot Metal Detector) 51 provided on the outlet side of the piercing mill 10.

The two inclined rolls 1 are provided opposed to each other with a pass line PL therebetween. The inclined rolls 1 have an inclination angle 6 and a crossed axes angle γ with respect to the pass line PL. The plug 2 is provided between the two inclined rolls 1 and on the pass line PL. The mandrel 3 is provided along the pass line PL on the outlet side of the piercing mill 10 and has its tip end connected to the rear end of the plug 2.

The pusher 4 is provided in the front of the inlet side of the piercing mill 10 and along the pass line PL. The pusher 4 includes a cylinder main body 41, a cylinder shaft 42, a connection member 43, and a billet push rod 44. The billet push rod 44 is coupled with the cylinder shaft 42 by the connection member 43 so that it can rotate in the circumferential direction. The connection portion 43 includes for example a bearing that allows the billet push rod 44 to rotate in the circumferential direction.

The cylinder main body 41 is a hydraulic or electromotive type device and advances/withdraws the cylinder shaft 42. The pusher 4 has the tip end surface of the billet push rod 44 abutted against the rear end surface of the round billet 20, and the cylinder shaft 42 and the billet push rod 44 are advanced by the cylinder main body 41, so that the round billet 20 is pushed forward from behind.

The pusher 4 advances the round billet 20 forward along the pass line and pushes it in between the two inclined rolls 1. The pusher 4 further advances the round billet 20 at least until the round billet 20 advances for a prescribed distance after it contacts the inclined rolls. Stated differently, the pusher 4 pushes the round billet 20 forward with no defective biting until the round billet 20 is stably pierced and rolled.

The HMD 51 as a detector is provided on the outlet side of the piercing mill 10 and near the rear ends of the inclined rolls 1. The HMD 51 detects whether the tip end of the round billet 20 pierced and rolled (i.e., hollow shell) has passed between the inclined rolls 1. When the HMD 51 detects the tip end of the pierced and rolled round billet 20, the pusher 4 stops pushing the round billet 20. At the inlet trough 7, a round billet 20 yet to be pierced and rolled is placed. Note that the piercing mill 1 includes two guides above and below the plug 2 though not shown in FIG. 1. The guides are for example disk rolls.

Figure 3:
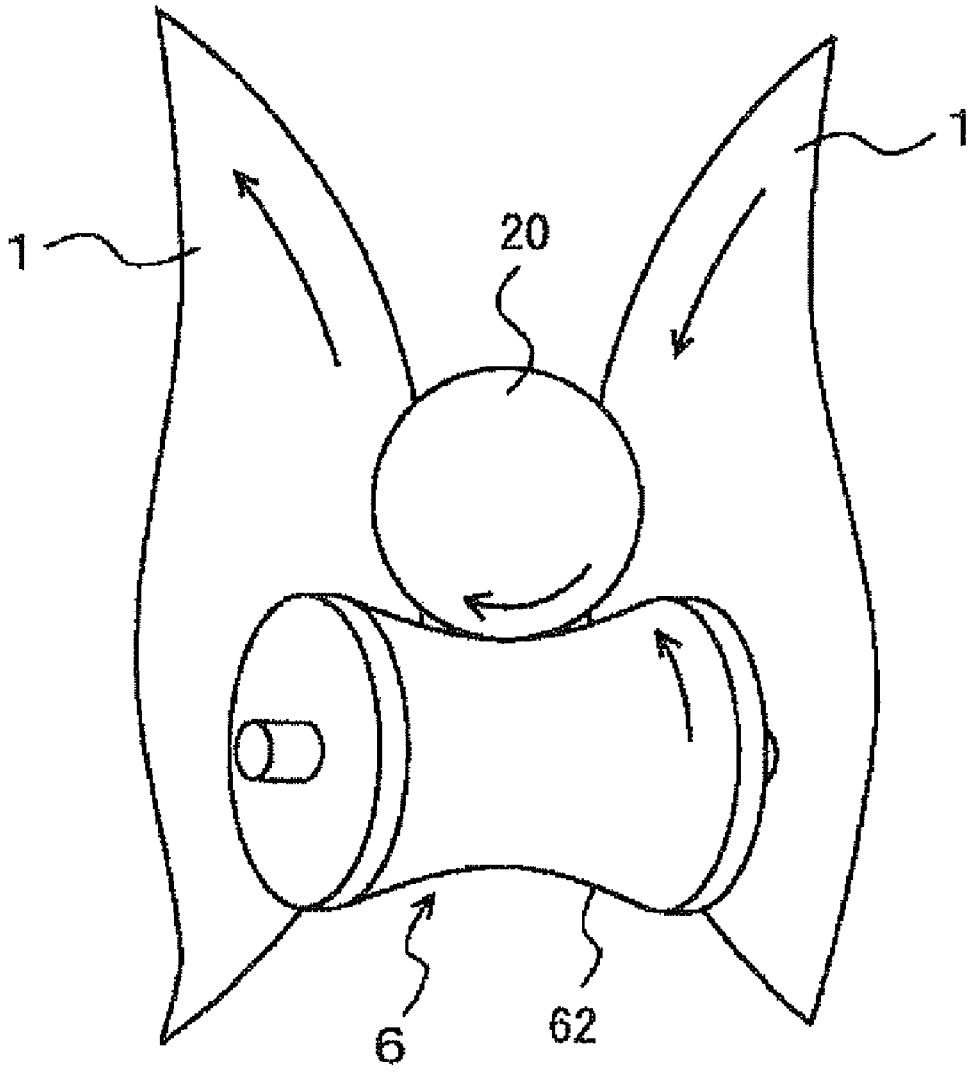
FIG. 3 is a schematic view showing the rotation direction of inclined rolls, a guide roll, and a round billet as viewed from the inlet side of the piercing mill.

The piercing mill 10 further includes a guide roll 6. The guide roll 6 is provided between the pusher 4 and the inclined rolls 1. FIG. 3 is a schematic view of the inclined rolls 1, the guide roll 6 and the round billet 20 during piercing and rolling operation when viewed from the inlet side of the piercing mill 10. As shown in FIG. 3, the height of the guide roll 6 is adjusted so that the surface of the round billet 20 pushed by the pusher 4 contacts the surface 62 of the guide roll.

Referring back to FIG. 1, the guide roll 6 includes a roll shaft 61 and the roll surface 62. The roll shaft 61 is arranged obliquely with respect to the pass line PL. Since the roll shaft 61 is inclined with respect to the pass line PL in this way, the guide roll 6 can provide the round billet 20 with rotation in the circumferential direction.

The roll surface 62 has an arch section in the direction of the roll shaft 61. Therefore, the round billet 20 passing on the guide roll 6 is not easily shifted in the horizontal direction and from the pass line PL. As compared to the case in which the roll surface 62 is flat, the contact region (contact area) between the roll surface 62 and the round billet 20 is large. Therefore, the force of the guide roll 6 to grip the round billet 20 is large, which allows the round billet 20 to be rotated more easily.

The guide roll 6 is not coupled to a driving source such as a motor. More specifically, the guide roll 6 is an undriven, free roll. Therefore, the guide roll 6 is rotated by external force received from the round billet 20 when the round billet 20 pushed by the pusher 4 contacts the roll surface 62. In this way, the guide roll 6 rotates by the external force from the round billet 20, and therefore the component of the advancing direction of the round billet 20 in the rotation speed of the guide roll 6 is substantially equal to the advancing speed of the round billet 20. Consequently, the guide roll 6 does not easily run idle and slip on the surface of the round billet 20. As a result, outer surface defects on the round billet 20 attributable to the slipping can be restrained.

As shown in FIG. 1, when the inclined rolls 1 are rotated anticlockwise as viewed from the inlet side of the piercing mill 10, the guide roll 6 is provided obliquely with respect to the pass line PL so that the right end 61R of the roll shaft 61 is closer to the plug 2 than the left end 61L. In this way, as shown in FIG. 3, the rotation direction provided to the round billet 20 by the guide roll 6 matches the rotation direction provided to the round billet 20 by the inclined rolls 1. Therefore, the friction force in the rotation direction (torque) when the round billet 20 contacts the inclined rolls 1 can be restrained.

Note that when the inclined rolls 1 are rotated clockwise as viewed from the inlet side of the piercing mill 10, the guide roll 6 is provided so that the left end 61L is closer to the plug 2 than the right end 61R. In short, the guide roll 6 is provided so that the rotation direction provided to the round billet 20 by the guide roll 6 matches the rotation direction provided to the round billet 20 by the inclined rolls 1.

Operation of Piercing Mill During Piercing and Rolling

Now, the operation of the piercing mill 10 during piercing and rolling will be described.

The round billet 20 is provided on the inlet trough 7. Then, the pusher 4 advances the billet push rod 44 to have the tip end of the billet push rod 44 contacted to the rear end of the round billet 20. Then, the pusher 4 advances the billet push rod 44 and moves the round billet 20 toward the inclined rolls 1. The round billet 20 advances on the inlet trough 7 as it is pushed by the pusher 4.

When the tip end of the round billet 20 contacts the roll surface 62 of the guide roll 6, the guide roll 6 starts to rotate following the movement of the round billet 20. At the time, the guide roll 6 is provided obliquely with respect to the pass line PL, and therefore the guide roll 6 provides the round billet 20 with rotation. As a result, the round billet 20 advances as it helically rotates.

The pusher 4 advances the round billet 20 after the round billet 20 starts to be rotated by the guide roll 6. Therefore, the round billet 20 contacts the surface of the inclined rolls 1 as it rotates. The pusher 4 pushes the round billet 20 forward for a prescribed distance after the round billet 20 contacts the inclined rolls 1. This is for the purpose of restraining defective biting.

The round billet 20 rotates in advance in the same direction as the direction of rotation provided by the inclined rolls 1. Therefore, the friction force applied to the inclined rolls 1 is smaller than when the round billet 20 is bitten between the inclined rolls 1 without being rotated. As a result, the wear amount of the inclined rolls 1 is reduced.

When the HMD 51 provided behind the inclined rolls 1 detects the tip end of the pierced and rolled round billet 20, the pusher 4 stops pushing the round billet 20. This is because when the tip end of the round billet 20 passes the rear ends of the inclined rolls, the piercing and rolling moves from a non-steady state to a steady state, and therefore the round billet 20 is pierced and rolled stably at a constant advancing speed if the pusher 4 does not push the round billet 20. Here, the non-steady state refers to the period between when the tip end of the round billet 20 contacts the inclined rolls 1 and when the tip end of the pierced and rolled round billet 20 passes (departs) the rear end of the inclined rolls 1. The steady state refers to the period after the non-steady state, in other words, the period after the tip end of the pierced and rolled round billet 20 passes the rear ends of the inclined rolls 1 in which the round billet 20 is pierced and rolled at a substantially constant advancing speed.

Note that according to the above-described embodiment, the pusher 4 continues to push the round billet 20 until the piercing and rolling reaches the steady state, while the pusher 4 may stop pushing the round billet 20 with a different timing. For example, the pusher 4 may stop pushing the round billet 20 in the non-steady state. The effects of invention are obtained as long as the pusher 4 continues to push the round billet 20 at least until the round billet 20 advances for a prescribed distance after it contacts the surfaces of the inclined rolls 1.

Second Embodiment

According to the above-described embodiment, only one guide roll is provided, while two guide rolls may be provided.

Figure 4:
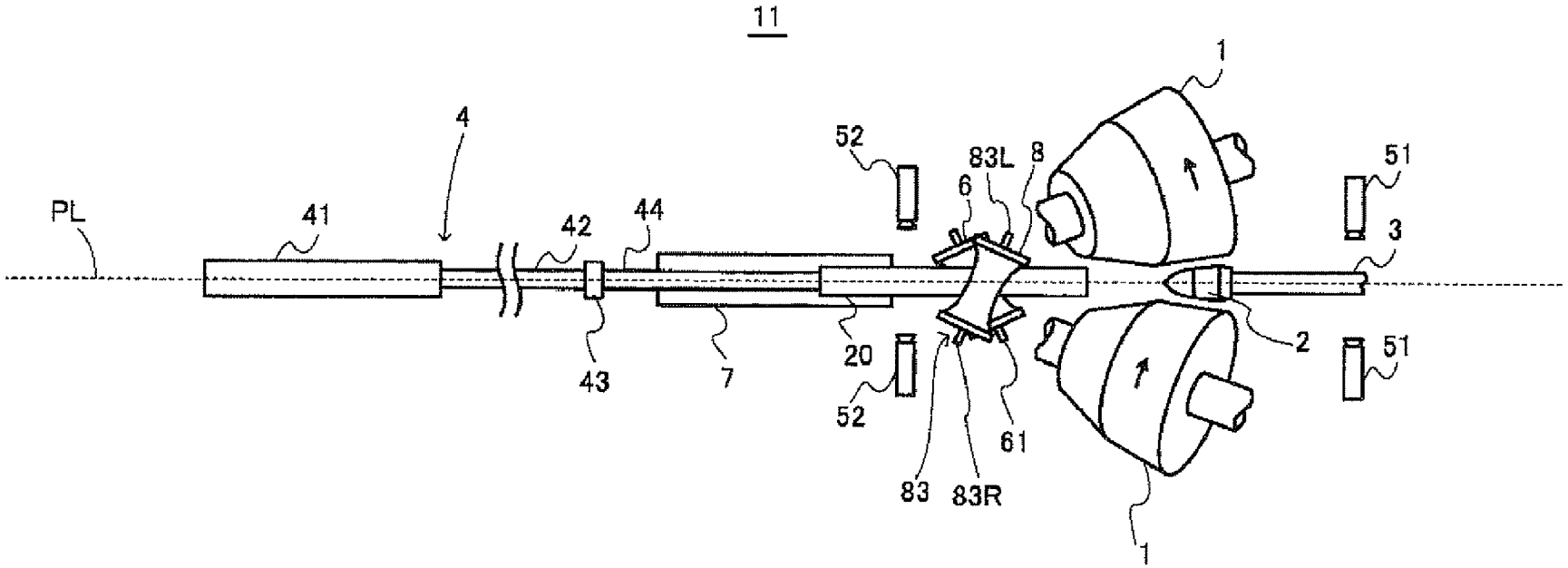
FIG. 4 is a schematic view of a piercing mill according to a second embodiment of the invention as viewed from above.
Figure 5:
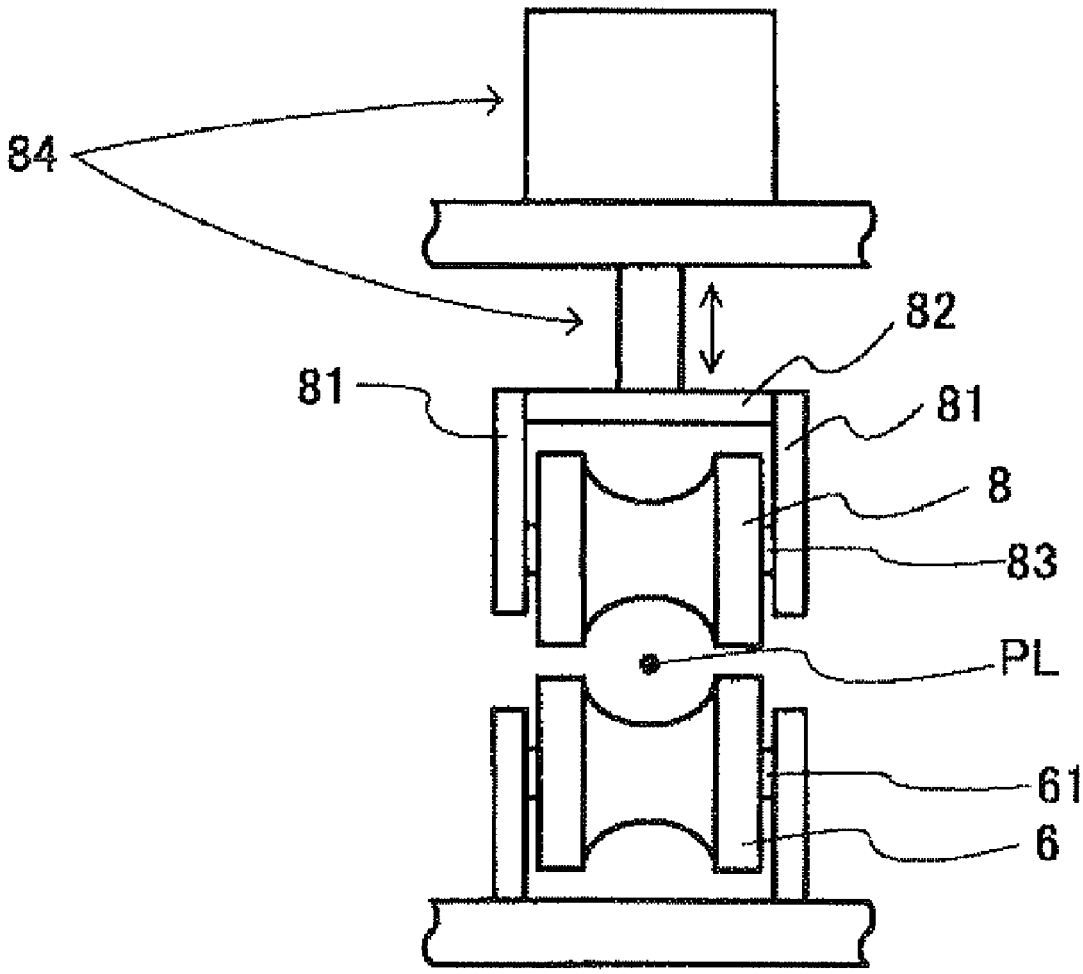
FIG. 5 is a front view of the guide roll shown in FIG. 4.

With reference to FIGS. 4 and 5, a piercing mill 11 according to a second embodiment includes a guide roll 8 in addition to the first embodiment. The guide roll 8 is provided opposed to the guide roll 6 with the pass line PL therebetween. The guide roll 8 is supported by a chock 81. The guide roll 8 is elevated/lowered in the vertical direction by an elevator 84 (for example a hydraulic or electromotive cylinder) connected to a chock support plate 82. As shown in FIG. 4, the roll shaft 61 of the guide roll 6 and the roll shaft 83 of the guide roll 8 cross each other. The roll shaft 83 is provided obliquely with respect to the pass line PL. More preferably, when the inclined rolls 1 rotate anticlockwise as viewed from the inlet side of the piercing mill 11, the guide roll 8 is provided obliquely with respect to the pass Line PL so that the left end 83L of the roll shaft 83 is closer to the plug 2 than the right end 83R. The roll surface of the guide roll 8 has the same shape as that of the surface 62 of the guide roll 6. More specifically, the roll surface of the guide roll 8 has an arch section in the direction of the roll shaft. Note that in FIG. 5, the roll shafts 61 and 83 of the guide rolls 6 and 8 are provided orthogonally to the pass line PL, while the inclination of the guide rolls 6 and 8 with respect to the pass line PL can be adjusted as desired. Therefore, during piercing and rolling, the guide rolls 6 and 8 are provided so that the roll shafts 61 and 83 are provided obliquely with respect to the pass line PL and the roll shafts 61 and 83 cross each other.

Figure 6:
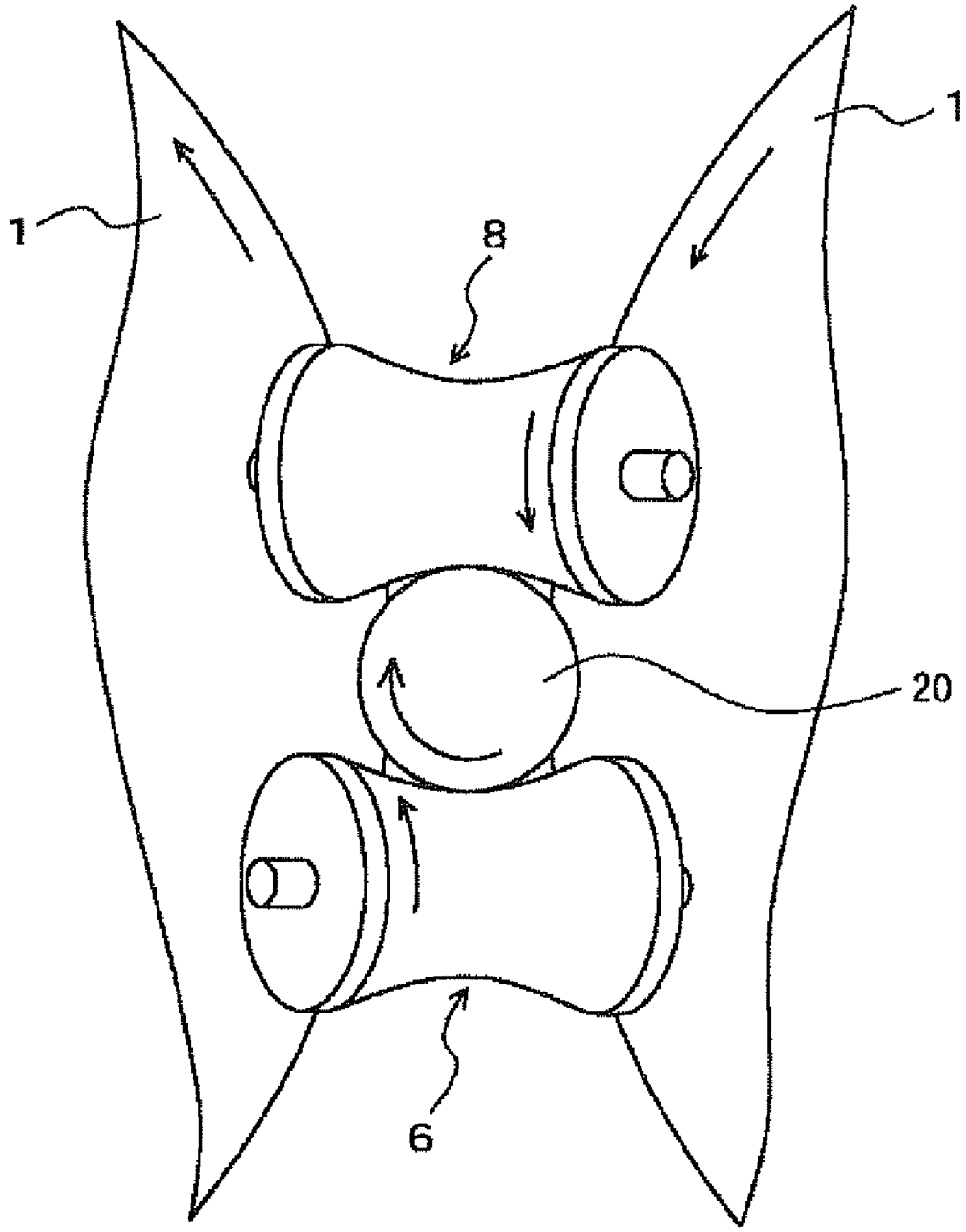
FIG. 6 is a schematic view showing the rotation direction of the inclined rolls, the guide roll, and a round billet as viewed from the inlet side of the piercing mill.

As the round billet 20 pushed forward by the pusher 4 passes on the guide roll 6, the elevator 84 lowers the guide roll 8. Therefore, the round billet 20 is held between the guide rolls 6 and 8. More specifically, the surface of the round billet 20 contacts the roll surfaces of the guide rolls 6 and 8. Since the roll shafts 61 and 83 cross each other, the guide rolls 6 and 8 both provide the round billet 20 with rotation in the same direction as shown in FIG. 6.

The round billet 20 advances as it is held between the guide rolls 6 and 8. Therefore, the round billet 20 is not easily shifted from the pass line PL in the horizontal direction and advances straightforward stably along the pass line PL. Furthermore, the two guide rolls rotate the round billet 20 in the circumferential direction as they hold the round billet 20 between them, and therefore the rotation is stabilized. The guide roll 8 is not coupled to a driving source similarly to the guide roll 6, in other words, it is an undriven, free roll. Therefore, the guide roll 8 does not easily slip at the surface of the round billet 20.

The elevating/lowering timing of the guide roll 8 is for example determined by an HMD 52 shown in FIG. 4. The HMD 52 is provided before the guide rolls 6 and 8. The elevator 84 lowers the guide roll 8 a prescribed period after the tip end of the round billet 20 passes the HMD 52. In this way, the two guide rolls 6 and 8 can hold the round billet 20 between them. When the HMD 51 detects the tip end of the pierced and rolled round billet 20, the elevator 84 elevates the guide roll 8. This is because the piercing and rolling moves to the steady state. On the other hand, even after the transition to the steady state, the guide rolls 6 and 8 may continue to hold the round billet 20.

Third Embodiment

Figure 7:
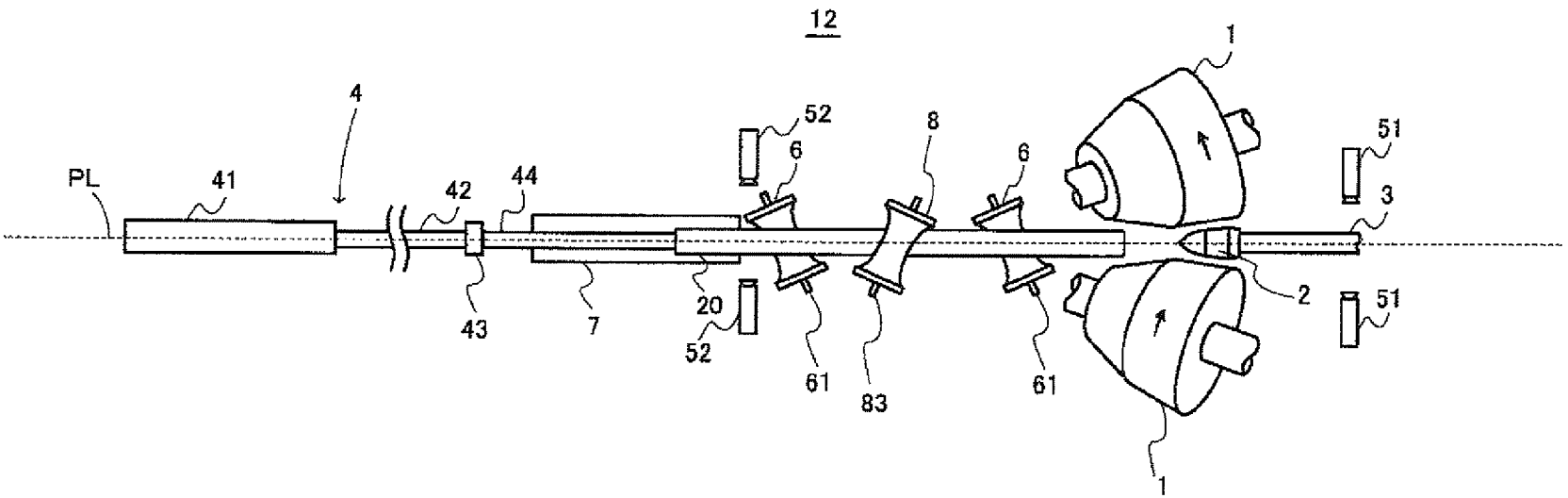
FIG. 7 is a schematic view of a piercing mill according to a third embodiment of the invention as viewed from above.

With reference to FIG. 7, a piercing mill 12 according to a third embodiment includes a plurality of guide rolls 6 in addition to the second embodiment.

The plurality of guide rolls 6 and the guide roll 8 are arranged zigzag along the pass line PL. More specifically, the guide rolls 6 and guide roll 8 are arranged so that the pass line PL is provided between them. The guide rolls 6 and the guide roll 8 are provided alternately along the pass line PL. The other structure is the same as that shown in FIG. 4. The timing of elevating/lowering the guide roll 8 is the same as that of the second embodiment.

In this case, the round billet 20 advances as it is held between the guide rolls 6 and 8 as is the case with the second embodiment. Therefore, the round billet 20 is not easily shifted in the horizontal direction from the pass line PL.

Since the guide rolls 6 and 8 are arranged zigzag, the round billet 20 advances as it is further held by the guide rolls 6 and 8 in three different points in the lengthwise direction. In this way, the front and rear ends of the round billet 20 are less likely to be shifted from the pass line PL in the vertical direction. Therefore, the round billet 20 advances straightforward in an even more stable manner along the pass line PL.

Note that in FIG. 7, the piercing mill 12 includes the two guide rolls 6 and the one guide roll 8, but the piercing mill 12 may include one guide roll 6 and a plurality of guide rolls 8. Alternatively, there may be a plurality of guide rolls 6 and a plurality of guide rolls 8.

According to the embodiment described above, the roll surfaces of the guide rolls 6 and 8 each have a concave arch shaped section, and the concave arch shape is for example a circular or elliptical shape. The shape may be a curve having a plurality of concave curvatures or may include a straight segment. The roll surfaces of the guide rolls 6 and 8 preferably have geometrically designed shapes to be in contact with the surface of the round billet 20.

According to the second embodiment, the guide rolls 6 and 8 are provided in the vertical direction with the pass line PL between them but they may be arranged in the horizontal direction.

According to the embodiment, there are two inclined rolls but there may be three or more inclined rolls. The inclined roll 1 is a cone type but it may be a barrel type.

Example 1

Using the piercing mill according to the invention including undriven guide rolls and a piercing mill shown in FIG. 1 removed of the guide rolls 6 (hereinafter referred to as "comparative piercing mill"), a plurality of round billets were pierced and rolled while they were each pushed by the pusher, after the rolling, the wear amounts of the inclined rolls were measured.

Examination Method

For each of the inventive piercing mill and the comparative piercing mill, the inclination angle δ was 10°, the crossed axes angle γ was 15°, the billet diameter reduction at plug nose was 4%, the roll diameter at the roll gorge portion was 410 mm, and the roll revolution number N was 1 rps. The piercing mills each included two inclined rolls. The inventive piercing mill included two guide rolls according to the second embodiment.

A round billet of SUS 304 stainless steel according to JIS standards having an outer diameter of 70 mm was heated to 1200° C., and then pierced and rolled by each piercing mill into a hollow shell having an outer diameter of 75 mm and a thickness of 5 mm. The inventive and comparative piercing mills each pierced and rolled a plurality of such round billets. More specifically, the pushing force of the pusher was set to values in test conditions 1 to 4 in Table 1 and 50 round billets were pierced and rolled in each of the test conditions.

TABLE 1

| test condition | pushing force (ton) | billet outer diameter (mm) | inclined roll wear amount in comparative piercing mill (mm) | inclined roll wear amount in inventive piercing mill (mm) |
|---|---|---|---|---|
| 1 | 4 | 70 | 0.6 | 0.3 |
| 2 | 3 | 70 | 0.3 | 0.12 |
| 3 | 2 | 70 | 0.2 | 0.08 |
| 4 | 1 | 70 | 0.1 | 0.04 |

After the 50 round billets were pierced and rolled in each of test conditions 1 to 4, the wear amount at the inclined rolls in each of the piercing mills was measured by the following method. The inclined rolls before piercing operation were each attached to a lathe and marked in eight arbitrary positions in the circumferential direction. Then, the profiles of each sectional shape in the roll shaft direction including each marking position at the roll surface between the inlet side tip end of the inclined roll and the gorge portion were measured using a dial gauge. Then, after the piercing and rolling, each of the inclined rolls was again attached to the lathe and the profiles at the roll surface were measured in the same manner as that carried out before the piercing operation. The profiles before and after the piercing were compared to produce the wear amounts.

Result of Examination

The wear amounts of the inclined rolls in each test condition are given in Table 1. With reference to Table 1, in each of test conditions 1 to 4, the wear amount of the inventive piercing mill was smaller than that of the comparative piercing mill.

Example 2

Using the inventive piercing mill having the structure shown in FIG. 7 and the comparative piercing mill described above, a plurality of round billets were pierced and rolled while they were each pushed by the pusher, and after the rolling, the wear amounts of the inclined rolls were measured.

Examination Method

For each of the inventive piercing mill and the comparative piercing mill, the inclination angle δ was 10°, the crossed axes angle γ was 15°, the billet diameter reduction at plug nose was 3.1%, the roll diameter at the roll gorge portion was 410 mm, and the roll revolution number N was 1 rps.

A round billet of alloy steel containing 13 mass % Cr (13% Cr steel) and having an outer diameter of 70 mm was prepared. The prepared round billet was heated to 1200° C., and then pierced and rolled by each piercing mill into a hollow shell having an outer diameter of 75 mm and a thickness of 5 mm. The inventive and comparative piercing mills each pierced and rolled a plurality of such round billets. More specifically, the pushing force of the pusher was set to values in test conditions 5 to 8 in Table 2 and 60 round billets were pierced and rolled in each of the test conditions.

TABLE 2

| test condition | pushing force (ton) | billet outer diameter (mm) | inclined roll wear amount in comparative piercing mill (mm) | inclined roll wear amount in inventive piercing mill (mm) |
|---|---|---|---|---|
| 5 | 4.2 | 70 | 0.62 | 0.36 |
| 6 | 3.1 | 70 | 0.30 | 0.15 |
| 7 | 2.5 | 70 | 0.23 | 0.11 |
| 8 | 1.5 | 70 | 0.15 | 0.06 |

After 60 round billets were pierced and rolled in each of test conditions 5 to 8, the inclined rolls of the piercing mills were measured for their wear amounts. The wear amounts were measured in the same manner as that of Example 1.

Result of Examination

The wear amounts of the inclined rolls in each of the test conditions are given in Table 2. With reference to Table 2, in any of test conditions 5 to 8, the wear amount of the inventive piercing mill was smaller than that of the comparative piercing mill.

Although the embodiment of the present invention has been described, the same is by way of illustration and example only and is not to be taken by way of limitation. The invention may be embodied in various modified forms without departing from the spirit and scope of the invention.

INDUSTRIAL APPLICABILITY

The piercing mill according to the invention is applicable for wide use in the field of piercing and rolling metal pipes or tubes.

The invention claimed is:

1. A piercing mill piercing and rolling a round billet into a hollow shell, comprising:

a plurality of inclined rolls provided around a pass line;

a pusher provided in front of said inclined rolls to push said round billet from a rear end of said round billet at least until said round billet advances for a prescribed distance after contacting said inclined rolls, said pusher including a billet push rod contacted to the rear end of said round billet; and an undriven first guide roll provided between said inclined rolls and said pusher, including a first roll shaft arranged obliquely with respect to said pass line and a first roll surface having a concave arch sectional shape in the direction of said first roll shaft and rotating said round billet in advance in the same direction as the direction of rotation provided by said inclined rolls.

2. The piercing mill according to claim 1, further comprising an undriven second guide roll provided opposed to said first guide roll with said pass line therebetween and including a second roll shaft crossing said first roll shaft and a second roll surface having a concave arch sectional shape in the direction of said second roll shaft.

3. The piercing mill according to claim 2, comprising a plurality of said first guide rolls, wherein said plurality of first guide rolls and said second guide roll are arranged zigzag along said pass line.

* * * * *